166-308 SR
2/24/87 XR 4,645,005

United States Patent [19]
Ferguson

[11] Patent Number: 4,645,005
[45] Date of Patent: Feb. 24, 1987

[54] METHOD OF PRODUCING HEAVY OILS

[75] Inventor: Noble B. Ferguson, Tulsa, Okla.

[73] Assignee: Amoco Corporation (formerly Standard Oil Co.), Chicago, Ill.

[21] Appl. No.: 723,765

[22] Filed: Apr. 16, 1985

[51] Int. Cl.[4] ..... E21B 43/04; E21B 43/24; E21B 43/26

[52] U.S. Cl. ..... 166/278; 166/303; 166/308

[58] Field of Search ..... 166/276, 278, 303, 308

[56] References Cited

U.S. PATENT DOCUMENTS

| | | | |
|---|---|---|---|
| 2,814,347 | 11/1957 | MacKnight | 166/278 |
| 2,955,653 | 10/1960 | Cain | 166/278 |
| 2,978,024 | 4/1961 | Davis | 166/278 |
| 3,075,463 | 1/1963 | Eilers et al. | 166/308 UX |
| 3,330,353 | 7/1967 | Flohr | 166/303 X |
| 3,349,849 | 10/1967 | Closmann | 166/303 X |
| 3,739,852 | 6/1973 | Woods et al. | 166/308 X |
| 4,109,723 | 8/1978 | Widmyer | 166/303 |

OTHER PUBLICATIONS

Lanfranchi, Edalfo, et al, "Result of the Application of Alternating Steam Injection in Heavy Oil in South--Eastern Venezuela", *Oil Sands*, 1977, pp. 584–591.

*Primary Examiner*—George A. Suchfield
*Attorney, Agent, or Firm*—F. E. Hook; R. R. Cochran; T. H. Briggs

[57] ABSTRACT

A method of producing viscous oils from reservoirs containing unconsolidated or friable sands comprising drilling the well, stimulating same with steam at a pressure sufficient to fracture the reservoir adjacent the well, shutting in the well, installing a gravel pack, producing oil from the well, and periodically, subsequently stimulating the well by injecting steam at a pressure below that which would result in a fracture of the reservoir.

3 Claims, No Drawings

METHOD OF PRODUCING HEAVY OILS

BACKGROUND OF THE INVENTION

The field of this invention relates to an improved method for producing viscous oils utilizing steam stimulation.

Many sources of heavy oils are available in various parts of the world. One of the largest is the Athabasca tar sand region in Alberta, Canada. Somewhat similar oils exist in California. To the present time, production of these wells has been difficult for various reasons.

Frequently, the sandstone reservoirs in which heavy oils occur contain at least partially unconsolidated sands or friable sands. Production of sand leads to serious consequences with the production equipment.

To avoid sand production, it has been customary to use a gravel pack. Such gravel packs are conventionally used where unconsolidated sands are present.

To produce the heavy oils discussed above, which may have a viscosity in the range of a few hundred to several million centipoise, it has been suggested that one use steam stimulation. By the nature of the deposit, such steam injection rates often reach and exceed the formation parting pressure. This in turn precludes the use of a gravel pack for controlling sand production as the gravel would be washed into the fracture upon steam stimulation.

An object of this invention is to provide an improved process for the production of heavy oils.

A further object of this invention relates to a process for producing viscous oils with a combination of steps including stimulating the well by injecting steam at a pressure sufficient to fracture the reservoir, shutting in the well, inserting a conventional gravel pack, producing oil, and periodically stimulating the well by injecting steam at a pressure below that which would result in a well fracture.

Other objects and advantages of this invention will be apparent to one skilled in the art upon reading this disclosure.

SUMMARY OF THE INVENTION

Broadly, this invention provides a method of producing viscous oils from a subterranean reservoir containing unconsolidated or friable sand, said reservoir being penetrated by at least one well in fluid communication therewith, comprising:

(a) stimulating said well by injecting steam at a pressure sufficient to fracture the reservoir adjacent the well;

(b) shutting in the well for a period of time;

(c) completing the wellbore with a conventional gravel pack;

(d) producing oil from said well; and (e) periodically, subsequently stimulating said well by injecting steam at a pressure below the pressure which would result in a well fracture.

The specific pressure and temperature ranges for the steam will, of course, depend upon the particular reservoir. In general, the steam pressure should be in the range of 300–3200 psi with a temperature in the range of 300°–700° F. Likewise, the time during which the well is shut in after the fracturing operation will vary from well to well, but the general range of 2 to 20 days is usually used. This time can be monitored by noting the pressure decline or fall off in the well, and the well should usually be kept shut in until the pressure declines to approximately 100 psi or less.

DETAILED DESCRIPTION OF THE INVENTION

The use of gravel packs is well established in the industry for sand control. A number of different systems are available, but they do find considerable use in unconsolidated and friable sands. In their use, the hole is completed as openhole and then enlarged to roughly twice the diameter of the casing. This provides a large interface with the producing sand. Generally, a slotted pipe with a screen around the same is inserted in the well and sand forced into the area between the screen and the surface of the formation. The screen is wrapped on the slotted base pipe. The gravel size generally ranges in the amount of five to ten times the formation grain size, U.S. mesh sizes normally being used. Pore sands found can range from 0.0625 to 2 mm in diameter. The use of a gravel pack in the production of heavy oils has frequently been unsuccessful to prevent sand production because upon steam stimulation above the fracturing pressure, the gravel in the gravel pack is forced into the formation. Thereafter, as the fracture contracts, the gravel is trapped in the sand and no longer functions for its desired purpose.

In such situations, the technique of the present invention becomes important, i.e., where the operator expects to inject at pressure above the formation parting pressure. These steps include drilling the well which should be cased to the top of the producing reservoir and completed openhole through at least a part of the sand containing the viscous oil. After these steps, the well is stimulated at the desired rate allowing the formation to part as necessary. Operable pressures and temperatures will, of course, depend upon the formation, but ranges have been given above. Following the stimulation, the well is left shut in. Observed wellhead pressures show when the fracture network has closed. With the fracture closed, filling the wellbore with fluid will not reopen the fracture. The well is then completed with the gravel pack for sand control. The screen is run and packed either by the more conventional method which involves circulating the gravel-carrying fluid back to surface or by pressure packing where the gravel-carrying fluid is displaced into the reservoir. With the formation heated and the gravel packing screen in place, the well is then used to produce oil from the formation.

While specific details of the process have been given, they should not be considered unduly limiting and those skilled in the art will recognize the broad scope of this invention.

I claim:

1. A method of producing viscous oils from a subterranean reservoir containing unconsolidated or friable sand, said reservoir being penetrated by at least one well in fluid communication therewith comprising:

(a) first, stimulating the reservoir by injecting steam through the well at a pressure sufficient to fracture the reservoir adjacent the well;

(b) next, shutting in the well for a period of time;

(c) then, completing the well adjacent the reservoir with a gravel pack;

(d) then, producing oil from the reservoir through the well; and (e) periodically, subsequently stimulating the reservoir by injecting steam through the well and into the reservoir at a pressure below the pressure which would fracture the reservoir adjacent the well.

2. The method of claim 1 wherein the steam pressure in said fracturing step is in the range of 300 to 3200 psi, and the temperature is in the range of 300° to 700° F.

3. The method of claim 1 wherein the well is shut in for a period of 2 to 20 days.

* * * * *